US006767073B2

(12) United States Patent
Tschida

(10) Patent No.: US 6,767,073 B2
(45) Date of Patent: Jul. 27, 2004

(54) HIGH-SPEED, HIGH-RESOLUTION COLOR PRINTING APPARATUS AND METHOD

(75) Inventor: Mark J. Tschida, Portland, OR (US)

(73) Assignee: Wellspring Trust, Portland, OR (US)

( * ) Notice: Subject to any disclaimer, the term of this patent is extended or adjusted under 35 U.S.C. 154(b) by 0 days.

(21) Appl. No.: 10/438,631

(22) Filed: May 14, 2003

(65) Prior Publication Data

US 2003/0214554 A1 Nov. 20, 2003

Related U.S. Application Data

(60) Provisional application No. 60/380,604, filed on May 14, 2002.

(51) Int. Cl.[7] ..... B41J 29/38; B41J 2/195

(52) U.S. Cl. ..... 347/13; 347/7

(58) Field of Search ..... 347/13, 12, 9, 347/5, 6, 7, 20, 1, 68, 95, 48, 98; 73/861; 346/139 R

(56) References Cited

U.S. PATENT DOCUMENTS

| | | | |
|---|---|---|---|
| 4,236,836 | A | 12/1980 | Hodne |
| 4,462,706 | A | 7/1984 | Matschke |
| 4,552,064 | A | 11/1985 | Sanders, Jr. et al. |
| 5,793,392 | A | 8/1998 | Tschida |
| 5,907,338 | A | 5/1999 | Burr et al. |
| 6,146,915 | A | 11/2000 | Pidwerbecki et al. |
| 6,305,790 | B1 | 10/2001 | Kawamura et al. |

OTHER PUBLICATIONS

"Ink Jet Printing with Large Pagewide Arrays: Issues and Challenges," Ross R. Allen, Proceedings of the International Conference on Digital Printing Technologies, 1996, pp. 43–49.

*Primary Examiner*—Raquel Yvette Gordon
(74) *Attorney, Agent, or Firm*—Marger Johnson & McCollom, P.C.

(57) ABSTRACT

Stationary print heads of this invention employ an array of conventional print heads that are reoriented 90 degrees relative to their conventional orientation such that the nozzle arrays in each print head are aligned perpendicular to the direction of print media movement. The reoriented print heads are positioned in at least first and second rows with the print heads in the first row spaced apart across the width of a printable image area. The print heads in the second row are similarly spaced apart but offset from the print heads in the first row. As the print medium continuously moves in one direction through the printer, the first and second rows of print heads print a wide swath comprising an entire linear row of dots across the width of the print medium. Continuously moving the print media, without conventional incremental movements or bidirectional print head scanning provides significantly increased printing speed and improved dot placement accuracy.

20 Claims, 6 Drawing Sheets

HIGH-SPEED, HIGH-RESOLUTION COLOR PRINTING APPARATUS AND METHOD

RELATED APPLICATIONS

This application claims priority from U.S. provisional patent application No. 60/380,604, filed May 14, 2002.

FEDERALLY SPONSORED RESEARCH OR DEVELOPMENT

Not applicable

TECHNICAL FIELD

This invention relates to dot matrix printers, and more particularly to dot matrix printers including stationary arrays of printing heads for printing at high-speed and high-resolution.

BACKGROUND OF THE INVENTION

Dot matrix printers typically include at least one print head with a plurality of individual printing elements arranged within the print head. A dot matrix printer typically actuates individual printing elements in the print head in a pattern of operation that is controlled by a stream of data in successive steps as the print head traverses a printing surface of a printing medium such as paper. During each step, the print head prints an area of dots and then move horizontally to a new position to print a succeeding area of dots. This process is repeated to produce a horizontal line of characters or other such image across the printing medium. After one horizontal line is printed, the print medium is typically incrementally moved in the vertical direction to permit another horizontal line of the image, such as a row of characters.

Therefore, dot matrix printers require successive actuation of one or more print heads typically including multiple printing elements arranged across a relative path of movement between the printing medium and the print head. One technique to progressively increase printing speed employs printing while moving in opposite directions back and forth in a rectangular path. Another technique employs multiple printing heads arranged side-by-side along a rectangular path. Another technique for increasing speed, employs double or multiple height print heads arranged across the rectangular path to simultaneously print two or more rows of characters during each traverse of the printing medium.

There are many examples of previous rearrangements of dot matrix print heads or their printing elements for increasing printing speeds and/or image resolution. For example, U.S. Pat. No. 4,462,706 for STACKABLE DOT MATRIX PRINTING CARTRIDGE MODULES describes a stacked array of print heads that are stacked horizontally or vertically; U.S. Pat. No. 4,552,064 for DOT MATRIX PRINTERS AND PRINT HEADS THEREFOR describes a print head having the dimensions of a 34 pin head being 2.0 inches wide, 1.5 inches thick, and 14.2 inches in length; and U.S. Pat. No. 4,236,836 for DOT IMPACT PRINTER AND ACTUATOR THEREFOR describes a dot matrix printer in which 44 to 132 print heads are employed to print one line at a time.

U.S. Pat. No. 5,793,392 for PRINTING APPARATUS AND METHOD, which is assigned to the assignee of this application, describes a printing system for printing an image having a width on a printing medium. The printing system includes a print head array having multiple columns of print heads. Each column includes a plurality of print heads having varying positions in a first dimension in the print head array for printing in a corresponding printable column area of the printing medium and having a corresponding printable column width. The multiple columns of print heads are arranged for printing throughout the image width. A first mechanism moves the printing medium relative to the print head array in the first dimension to cause selected non-contiguous portions of a printable segment along a second dimension substantially perpendicular to the first dimension to be printed in each printable column area by the print heads. Further movement in the first dimension causes selected non-contiguous portions of multiple defined printable segments to be printed to fill the corresponding image portions of each column area. A second mechanism moves the print head array relative to the printing medium in the second dimension. A movement in the second dimension not more than the widest distance between any two non-contiguous portions of any printable segment in combination with the movement in the first dimension is sufficient to print all printable segments contained in the image.

Just as many types of dot matrix printers are available, a corresponding variety of print head types exist. For example, in electro-mechanical actuator impact print heads, a plurality of print wires are selectively driven by corresponding solenoids to impact a printing surface directly with or through a transfer ribbon. A commercially popular type of print head is an ink-jet print head which uses a number of individual ink-jets to pulse droplets of ink in spatial combinations to print characters as a sequence of dots. Another type of dot matrix print head is the thermal printer in which printing is carried out by contact of multiple heated printing elements to heat sensitive paper or to an intervening thermal transfer ribbon to print data on ordinary paper.

The ink-jet print head is typically mounted on a carriage that moves substantially perpendicular to a media motion direction, to enable an ink-jet type dot matrix printer to produce a line of characters or type. An advantage of the ink-jet print head is that other than the movement of the carriage and the drops of ink moving through the ink-jet print head, there are no moving parts such as in the electro-mechanical actuator impact print head. Another advantages of the ink-jet print head are its relatively high image quality, color purity, and low cost. Unfortunately, ink-jet printers print relatively slowly.

To increase printing speed, U.S. Pat. No. 5,907,338 describes a media-width ink jet print head having four rows of nozzles for ejecting four colors of ink. Unfortunately this print head is very expensive and still requires at least two printing passes to produce a high-resolution image.

As described above, skilled workers have approached the problem of increasing the printing speed of ink-jet printers in various ways including developing faster print heads, increasing the number of print heads per printer. These approaches have achieved printing speeds several orders of magnitude greater than those achievable twenty years ago. There are, however, significant design and manufacturing problems associated with further increasing the throughput of individual print heads or the number of print heads per printer.

Increasing the number of ink-jet nozzles per print head as well as increasing the frequency at which each nozzle is able to place dots on the print page increases the printing speed of individual ink-jet print heads. Currently, individual high-resolution print heads have ink-jet nozzle arrays for one, three, four, and six colors. It has been either infeasible or prohibitively expensive to manufacture high-density ink-jet nozzle arrays wider than one inch.

Increasing the number of print heads in a printer also increases the printing speed of a printer. Many color ink-jet printers employ a linear array of four or six single-color print heads or a linear array comprising a single-color and a multicolor print head. Some color ink-jet printers, such as ones described in the afore-mentioned U.S. Pat. No. 5,793,392, employ a linear or a two-dimensional array of twelve single-color print heads.

There are several significant problems encountered when trying to increase the number of print heads in a printer. A first problem is dot placement precision, and a second problem is the cost of manufacturing a precisely aligned array of print heads.

As a print head array scans bilaterally across the width of the page, significant error accumulates in the accuracy of placing the dots of the printed image. This dot placement error also accumulates due to reversing the direction of the print head array and the incremental movement of the print medium through the printer.

Suppose that the columns of print heads in the print head array evenly partition the entire width of the printable image area and the rows of print heads evenly partition a small segment of the length of the printable image area. Then, the dot placement error $E_i$ is represented mathematically as follows:

Let w and l be the width and length of the printable image area, respectively. Let $h_w$ and $h_l$ be the width and length of the printable image area that an individual print head in the array prints, respectively. Let R be the number of rows of print heads in the array. Let e be the dot placement error accumulated across $h_w$ due to a single unilateral pass of the print head array relative to the print medium. Let r be the dot placement error accumulated across $h_l$ due to reversing the direction of the print head array while bilaterally scanning. The errors e and r accumulate for every pass of the print head array, except the last pass for r.

Let p be the number of unilateral passes of the print head array across $h_l$. Then, the maximum dot placement error accumulated due to the bilateral scanning of the print head array is:

$$\frac{lp(e+r)}{Rh_l} - r$$

The incremental movement of the print medium through the printer is the cause of substantially more dot placement error. Let i be the error accumulated across $h_l$ due to the incremental movement of the print medium through the printer. Let j be the dot placement error accumulated across R−1 rows of print heads due to the incremental movement of the print medium through the printer in order to print the next segment of the printable image area. Then, the maximum dot placement error accumulated due to the incremental movement of the print medium across l is:

$$\frac{l(i+j)}{Rh_l} - j$$

Therefore, due to the Pythagorean theorem, the maximum possible dot placement error $E_1$ due to bilateral scanning, reversing directions and incremental print medium movement is:

$$E_1^2 = \left(\frac{lp(e+r)}{Rh_l} - r\right)^2 + \left(\frac{l(i+j)}{Rh_l} - j\right)^2$$

The dot placement error is not so noticeable when there are but a few rows of print heads in the print head array. The dot placement error for dots placed by adjacent rows of print heads, relative to one another, is small even though the absolute dot placement error across the entire printed image is large.

However, the problem is quite different when adding more and more rows of print heads to the print head array. After the two-dimensional print head array prints a segment of the printable image area $Rh_l$ in length, the entire array must move a distance of $(R-1)h_l$ to continue printing the remainder of the image. The accumulated dot placement error at the bottom of each segment of the printable image area accompanied by the incremental movement error j creates unacceptable artifacts, distortions and banding across the width of the image between segments of the printable image area.

What is still needed, therefore, is a low-cost printing system that rapidly provides high-quality, high-resolution color images.

SUMMARY OF THE INVENTION

An object of this invention is, therefore, to provide a low-cost printing apparatus and method employing a stationary print head array that rapidly provides high-quality, high-resolution color images.

Another object of this invention is to provide a stationary print head array manufacturing method.

A further object of this invention is to provide a software device driver method for coupling printers to various print head array configurations.

Stationary print heads of this invention employ an array of conventional print heads, which are designed to bidirectionally scan horizontally while a print medium incrementally moves vertically. The print heads are reoriented 90 degrees relative to the conventional orientation such that the nozzle arrays in each print head are aligned perpendicular to the direction of print media movement. The array of reoriented print heads are positioned in at least a first row and a second row with the print heads in the first row spaced apart across the width of a printable image area. The print heads in the second row are similarly spaced apart but offset from the print heads in the first row. As the print medium continuously moves in one direction through the printer, the first and second rows of print heads print a wide swath comprising an entire linear row of dots across the width of the print medium without any gaps in the printed image. Continuously moving the print media, without conventional incremental movements or bidirectional print head scanning provides significantly increased printing speed and improved dot placement accuracy.

The manufacturing method of this invention starts with an imprecisely aligned array of print heads, precisely measures their nozzle jetting positions within the array, and compensates for their imprecise alignment with a software device driver. No matter how large the print head array, the precision afforded by this manufacturing method is better than the manufacturing tolerances used to precisely align much smaller arrays employed for printing photographic quality images. Any gaps or overlaps in the dot placement caused by imprecise alignment of the print heads in the array is compensated for by having some print heads partially overlap the coverage areas of adjacent print heads. The device driver then steers and times printing to the appropriate nozzle(s) in the appropriate print head(s) to eliminate the gaps or overlaps.

Additional objects and advantages of this invention will be apparent from the following detailed description of preferred embodiments thereof that proceeds with reference to the accompanying drawings.

DETAILED DESCRIPTION OF PREFERRED EMBODIMENTS

Figure 1:
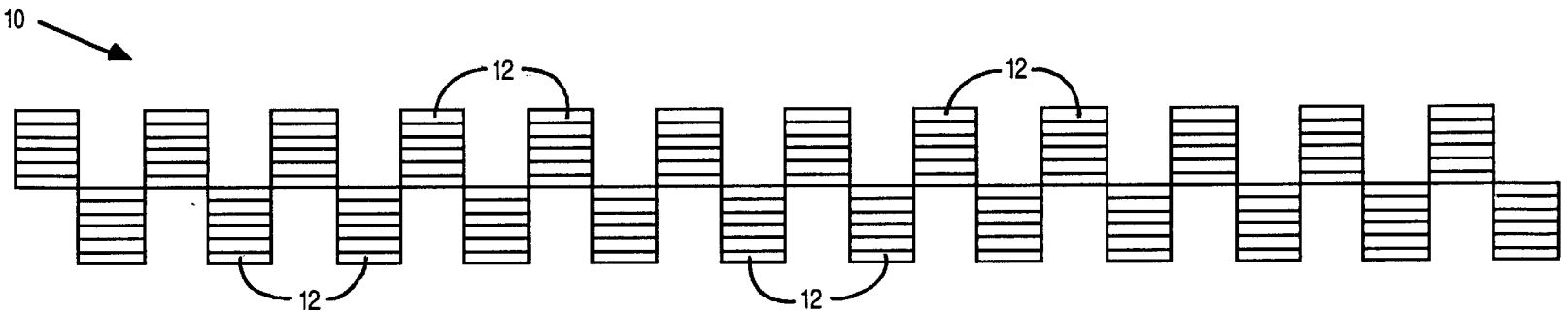
FIG. 1 is a simplified plan view of a stationary print head of this invention employing an array of Canon S-800 print heads without their associated print head assemblies.

The solution to the dot placement precision problem is to cover the entire length of the printable image area with a print head array consisting of one or more columns of print heads. This is counterintuitive because adding more columns of print heads in the print head array would seem to compound the dot placement precision problem. However, by covering the entire length of the printable image area with a print head array, no single print head prints more than one segment of the printable image area. If the columns of print heads are close enough together, the accumulated dot placement error within each segment is acceptable. There are many print head arrays with photographic quality color output currently on the market that support this fact.

This eliminates the dot placement error j accumulated across R−1 rows of print heads due to the incremental movement of the print medium through the printer in order to print the next segment of the printable image area. The dot placement error equation for this page length array is:

$$E_2^2=(p(e+r)-r)^2+i^2$$

The dot placement precision improves further by continuously moving the print medium, relative to the print head array, through the printer. Continuously moving the print medium creates a simple zigzag path of the print head array relative to the print medium. A double-high array of inkjet nozzles in each print head zigzagging at intervals the height of a single array of nozzles may be the easiest way to visualize this. This eliminates the error i accumulated across $h_l$ due to the incremental movement of the print medium through the printer. The dot placement error t generated across $h_l$ due to the continuous movement of the print medium through the printer is $t=h_l e/h_w<i$, assuming the same relative dot placement error whether the print head array or the print medium is moving. Therefore, the dot placement error equation now becomes:

$$E_3^2=(p(e+r)-r)^2+t^2$$

The dot placement error for a bilaterally scanning page length array is dramatically smaller than for a bilaterally scanning page wide array:

$$((p(e+r)-r)^2+t^2)^{1/2}<\left(\left(\frac{lp(e+r)}{h_l}-r\right)^2+\left(\frac{l(i+j)}{Rh_l}-j\right)^2\right)^{1/2}$$

Therefore, with a page length print head array, there is no need to interleave or microweave the rows of dots to help minimize artifacts, distortions and banding. All of this assumes that it is feasible to cost effectively manufacture a large print head array that is precisely aligned.

Multicolor thermal inkjet print heads are now available from many manufacturers, including Hewlett Packard and Canon, that have ink-jet nozzle arrays sufficiently dense to print a high-resolution swath, approximately a half an inch or more in height, in a single pass. These print heads make it possible to design a page length print head array that is capable of printing an entire page with a single pass of the print head array across the width of the page.

The dot placement error equation for this single-pass page length array eliminates the number of passes p as well as the dot placement errors r and t:

$$E_4=e$$

By reorienting this print head array 90°, the non-stationary page length array becomes a stationary page wide array. With the dot placement error $t_2$ generated across l due to the continuous movement of the print medium through the printer, the stationary page wide array has the same dot placement error as the non-stationary page length array, assuming w=l:

$$E_5=t_2=e$$

$$e<((p(e+r)-r)^2+t^2)^{1/2}<\left(\left(\frac{lp(e+r)}{h_l}-r\right)^2+\left(\frac{l(i+j)}{Rh_l}-j\right)^2\right)^{1/2}$$

This stationary print head array greatly simplifies the design of a printer by removing everything it takes to move the print head assembly back and forth as well as everything it takes to increment the print medium through the printer. A stationary page wide array is capable of faster multiple page printing speeds than a non-stationary page length array because the print medium moves continuously at high-speed without having to stop or even slow down.

A stationary print head array is capable of printing speeds several orders of magnitude greater than ink-jet print heads currently on the market. Again, all of this assumes that it is feasible to cost effectively manufacture a large print head array that is precisely aligned. The manufacturing method of this invention allos large print arrays to be manufactured inexpensively.

Stationary print heads of this invention provide increased printing speed coupled with reduced cost and complexity. The manufacturing method of this invention employs commercial off-the-shelf ("COTS") digital print heads to produce stationary print heads that avoid or reduce the capital, manufacturing, research, and development costs associated with digital home, office and production printers, and copiers.

Throughout this description, the term "stationary print head" refers to a single integrated stationary print head or a stationary array of individual prints heads. An integrated stationary print head and each individual print head within a stationary array of individual print heads may be a single or multicolor thermal (this includes bubble jet print heads), piezo, continuous or drop-on-demand ink-jet print head, or a print head employing any suitable print head technology. Furthermore, each individual print head in the array may be a COTS print head, a modified COTS print head, an ink-jet nozzle array, an ink-jet nozzle array assembly, or a specially developed print head. Exemplary COTS print heads may be manufactured by Hewlett-Packard Company ("HP"), Canon USA, Inc. ("Canon"), Seiko Epson Corporation ("Epson"), Lexmark International, Inc. ("Lexmark"), or Xerox Corporation ("Xerox").

Throughout this description, it should be further noted that this invention employs the manufacturing method of this invention, potentially in combination with one or more conventional manufacturing processes. For example, the ink-jet nozzles, the ink-jet nozzle arrays, and/or individual print heads of the stationary print heads of this invention are aligned employing the manufacturing method of this invention and/or some combination of conventional alignment processes.

Throughout this description, the term "printer" can refer to standalone and network home, office and production printers and copiers, multipurpose and all-in-one (i.e., scanner, copier, printer, facsimile) printers, large format printers, sheet fed and web printing presses, home and production photo printers, kiosk and point-of-sale printers, digital plate setters, facsimile machines, or any device that records an image on a surface of a print medium. Additionally, the term printer can refer to a duplexing printer.

Throughout this description, the terms "print medium" and "print media" refer to any type of media suitable for receiving an image. Exemplary print media include, but are not limited to, paper, plastic, fabric, or any media suitable for receiving an image. The print media can be flat or contoured, single-sided, double-sided, or many-sided.

This invention incorporates aspects of the above-described U.S. Pat. No. 5,793,392, which is incorporated herein by reference.

Stationary print heads provide dramatically faster printing than non-stationary print heads because they employ a significantly higher number of printing elements. Conventional printers with moving print heads waste time bilaterally scanning and incrementing the print media through the printer.

Stationary print heads produce higher-resolution images because they eliminate incrementally moving the print media through the printer and allow continuously moving the print media, which provides better dot placement accuracy. Stationary print heads can print photographic-quality images without resolution enhancement techniques, such as interlaced scanning or micro-weaving of dot rows to prevent image banding and other artifacts.

Stationary print heads allow single-pass, simultaneous single pass, or two-sided (duplex) printing, which effectively doubles printing speed.

The stationary print heads of this invention reduce the capital, manufacturing, research, and development costs of high-speed, high-resolution digital printers and copiers by employing arrays of COTS print heads.

Stationary print heads are modularly configurable to accommodate printing devices of various printing speeds and image dimensions. Pairs of stationary print heads arranged for duplex printing are potentially as fast as commercial sheet fed printing presses.

Stationary print heads have a sufficiently compact profile and dimensions that they can be installed or retrofitted to most printing devices.

Printers employing stationary print heads typically sense the speed of media motion past the print head by sensing a rotational velocity of the mechanism moving the imaging media past or through the stationary print head(s).

Arrays of COTS ink-jet print heads employed in stationary print heads have various features that enable high-speed, high-resolution digital printing. The large number of nozzles in each print head provide a wide printing swath, faster printing speed, smaller dimensions, lower array costs, and require fewer print heads in the stationary print head array. A greater nozzle jetting frequency, measured in dots per second, translates into faster printing speeds. A greater nozzle density provides increased dot placement accuracy and higher image resolution. Preferably the nozzle density matches the desired image resolution in at least one dimension. For example, a 1200 dpi nozzle density is sufficient to achieve a 1200 by 2400 dpi image resolution. A greater number of colors per print head provide improved color rendering accuracy. Four ink colors are required to print a typical cyan ("C"), magenta ("M"), yellow ("Y"), and black ("K") image, although, six colors are preferable for high-resolution, photo-quality ink-jet printing.

Several manufacturers provide high-frequency, high-resolution ink-jet print heads for printing hundreds of rows of dots per swath across a printed page without any gaps in the resulting image. The high nozzle density increases printing speed and dot placement accuracy by reducing the number of bilateral scans required to achieve sufficient ink coverage for a given image resolution.

For example, the HP PhotoREt II thermal ink-jet ("TIJ") print heads have ejection chambers sufficiently small to support a 1,200 nozzle per inch density. Such print heads can support single-pass, unidirectional scanning. Examples of printers employing similar single-pass print heads include the Canon S800 Color Bubble Jet Photo Printer, Canon S900 Photo Printer, and Canon i950 Photo Printer.

The stationary page-wide print head arrays of this invention employ multiple print heads, such as the above-described 1,200 nozzle per inch print heads. The greater number of nozzles, higher jetting frequency, nozzle density, number of colors, and the larger print swath, allow implementing high printing-speed in pages per minute ("ppm"), and the printing of photographic quality images. Stationary print heads of this invention preferably have the characteristics set forth below in Table 1.

TABLE 1

| | |
|---|---|
| Printing method | Thermal or piezo ink-jet |
| Print head type | Permanent or replaceable |
| Stationary print head dimensions | 8.5 by 2 by 1 inches |
| Print head scanning | None - stationary |
| Print medium feed | Continuous not incremental |
| Print medium delivery | Sheet fed and web |
| Types of inks | Pigment-based and dye-based<br>Aqueous and solvent-based |
| Ink replenishment | Continuous or replaceable ink tanks |
| Number of colors | Six - CMYKcm |
| Number of nozzles per color | 9600 |
| Total number of nozzles | 57600 |
| Nozzle frequency per second | 38000 |
| Dot size | 2–5 picoliters |
| True resolution | 1200 by 1200 dpi<br>1200 by 2400 dpi |
| Speed @ 1200 by 1200 dpi | 172+ ppm |
| Speed @ 1200 by 2400 dpi | 86+ ppm |
| Duplexing | Single pass |
| Duplex registration (side-to-side) | 1/2400th inch |
| Duplex speed @ 1200 by 1200 dpi | 344+ ppm |
| Duplex speed @ 1200 by 2400 dpi | 172+ ppm |

Stationary print heads of this invention may employ many models of single color and/or multicolor ink-jet nozzle arrays and/or ink-jet print heads, however, the print head employed in the Canon S800 Color Photo Printer is a preferred print head. The S800 six color bubble jet print head has 256 nozzles per color for a total of 1,536 nozzles capable of 1200 by 2400 dpi resolution with 4 picoliter ink droplets. The S800 printer is capable of printing a high-resolution 8 by 10 inch color image in two minutes (½ ppm). The print head dimensions are approximately one inch square disregarding the ink cartridge carriage. The ink-jet nozzle array is approximately 0.5 by 0.213 inch and is centered within the one square inch dimensions of the print head. The print head has a modular construction that allows discarding the plastic case securing the print head.

FIG. 1 shows a preferred embodiment of a 1200 by 2400 dpi six-color ink-jet stationary print head 10 employing an array of Canon S800 Color Bubble Jet Photo Printer ink-jet nozzle arrays 12 without their associated print head assemblies.

Figure 2:
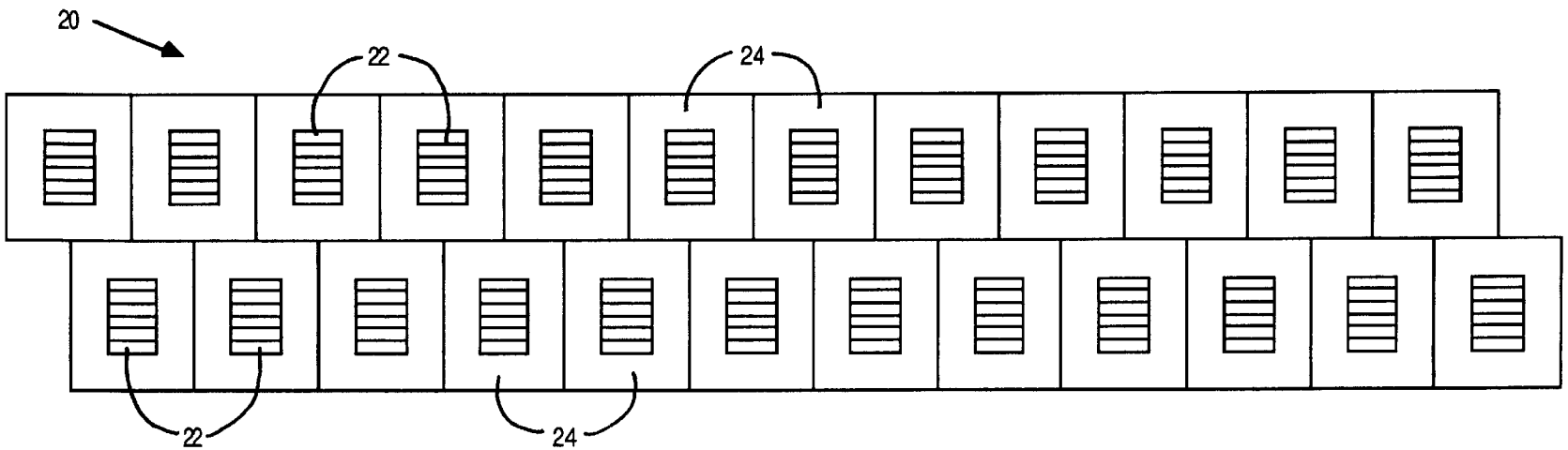
FIG. 2 is a simplified plan view of a stationary print head of this invention employing an array of Canon S-800 print heads with their associated print head assemblies.

FIG. 2 shows a preferred embodiment of a 1200 by 2400 dpi six-color ink-jet stationary print head 20 employing an array of Canon S800 Color Bubble Jet Photo Printer ink-jet nozzle arrays 22 with associated print head assemblies 24.

The Canon S900 and i950 Photo Printer multicolor print heads are even better suited for implementing stationary print heads. The Canon S900 Photo Printer print head is almost ideal for stationary print heads with respect to its number of nozzles, nozzle frequency, nozzle density, number of colors and the size of its print swath. This six-color bubble jet print head has 512 nozzles per color for a total of 3,072 nozzles capable of 1200 by 2400 dpi resolution with 3 picoliter ink droplets. This printer is capable of printing a high-resolution 8.5 by 11 inch borderless color image in about one minute (1 ppm). The nozzle face dimensions of this print head are approximately one square inch disregarding the ink cartridge carriage. The ink-jet nozzle array of this print head is approximately 0.5 by 0.43 inch and is centered within the one square inch dimensions of the print head. The print head has a modular design such that the plastic case for the print head can be discarded. This print head is also employed in the Canon S9000 Photo Printer wide format printer.

Figure 3:
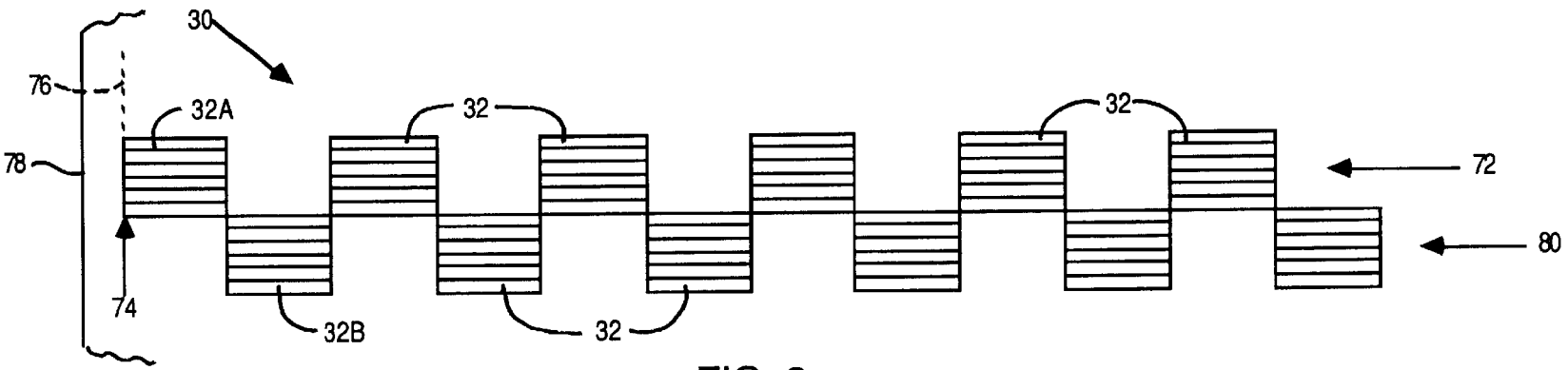
FIG. 3 is a simplified plan view of a stationary print head of this invention employing an array of Canon S-900 print heads without their associated print head assemblies.

FIG. 3 shows a preferred embodiment of a 1200 by 2400 dpi six-color ink-jet stationary print head 30 employing an array of Canon S900 Color Bubble Jet Photo Printer ink-jet nozzle arrays 32 without their associated print head assemblies.

Figure 4:
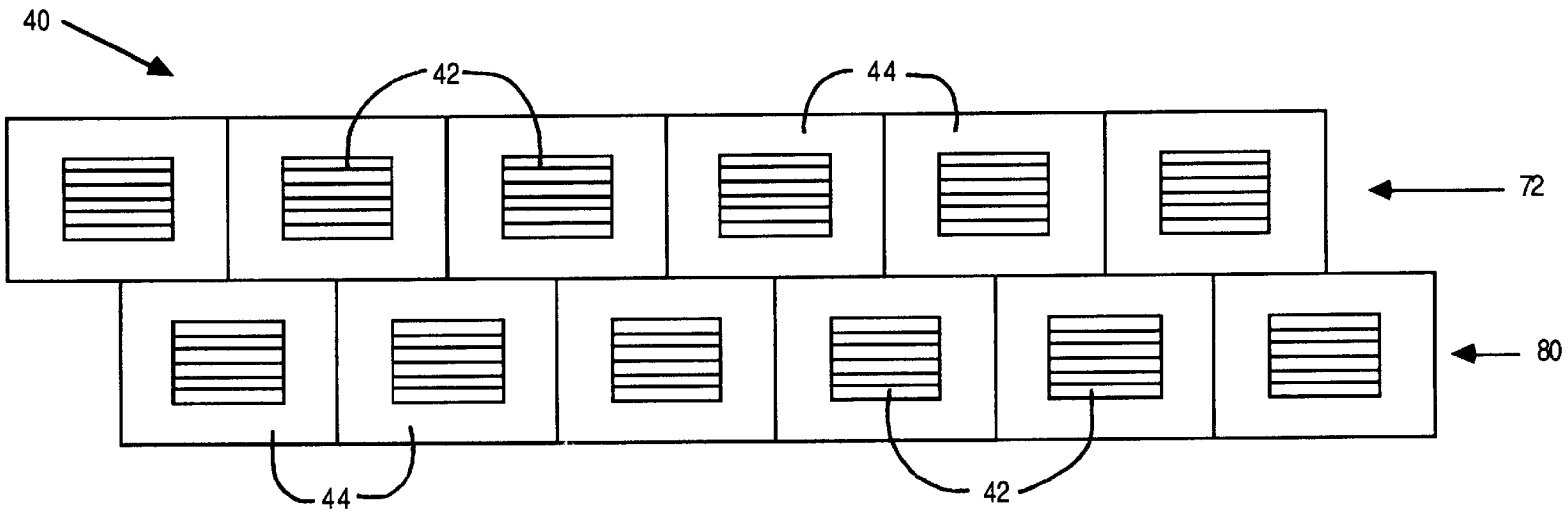
FIG. 4 is a simplified plan view of a stationary print head of this invention employing an array of Canon S-900 print heads with their associated print head assemblies.

FIG. 4 shows a preferred embodiment of a 1200 by 2400 dpi six-color ink-jet stationary print head 40 employing an array of Canon S900 Color Bubble Jet Photo Printer ink-jet nozzle arrays 42 with associated print head assemblies 44.

HP manufactures single color TIJ print heads having a nozzle array face that is approximately 0.75 inches square disregarding the ink container itself. The ink-jet nozzle array is approximately 0.5 inch long and is centered within the 0.75 inch square. The HP model 15, 40, and 45 single color ink-jet print heads are suitable for use with this invention.

HP also manufactures single color TIJ print heads having a nozzle array face that is approximately 0.75 inch by 0.25 inch disregarding the ink container itself. The ink-jet nozzle array is approximately 0.25 inch long and is centered within this area. The HP model 19, 20, 26, 29, and 33 single color inkjet print heads are suitable for use with this invention.

HP further manufactures multicolor TIJ print heads that are approximately 0.75 inch square disregarding the ink container itself. The ink-jet nozzle array is approximately 0.25 inch long and is centered within the 0.75 inch square area. These multicolor HP print heads can be modified such that they are approximately 0.75 inch by 0.25 inch disregarding the ink container itself. The HP model 16, 17, 23, 25, 41, 49, 78, 844, and 845 multicolor ink-jet print heads are suitable for use with this invention.

Figure 5:
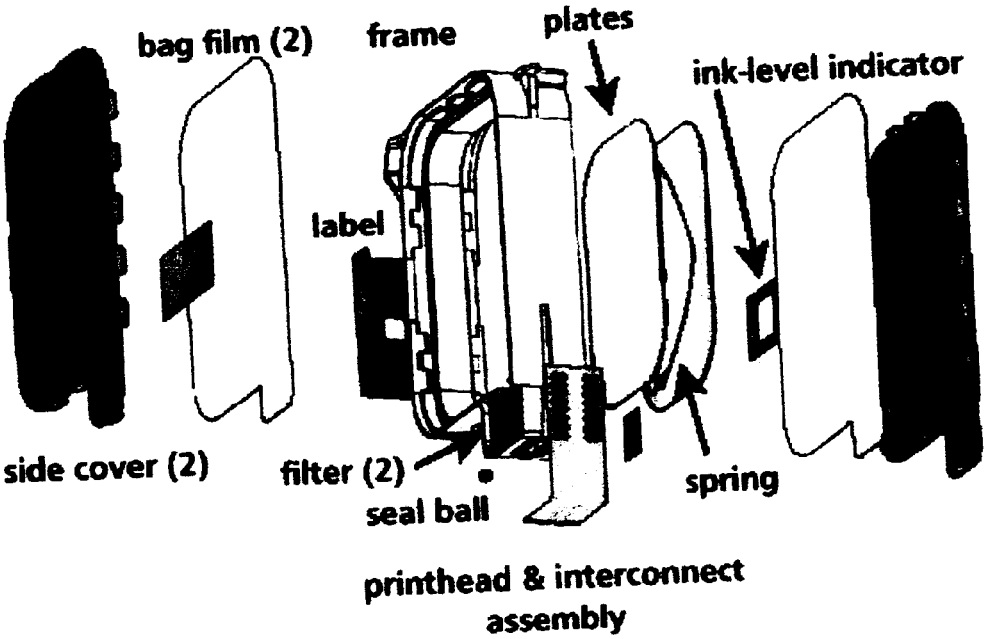
FIG. 5 is an isometric view of a typical HP ink-jet print head further shown exploded apart to reveal its modular construction.

The face of each print head containing the ink-jet nozzle array is significantly smaller than the rest of the print head. It is, therefore, preferred to separate the ink-jet nozzle array from remainder of the print head assembly, which is possible because most of the above-described print heads have a modular construction. FIG. 5 shows the modular construction of a typical HP print head.

The flex circuits of typical COTS print heads can be: accommodated as is by making room in a common case and ink container with slots for the circuit connections; contorted such that they take up less space (including the slots for the circuit connections); or modified such that they extend outside the stationary print head. For example, by extending the Canon S800 and S900 print head flex circuits to sides adjacent to their current positions, the stationary print head can be made to snap into place substantially the same way the individual print head assemblies snap into the Canon S800 and S900 printers. It may be necessary to make the circuit connector array in the flex circuit longer and narrower to achieve this. Contorting or modifying the flex circuits may be further necessary to implement two rows of print heads rather than three or more in order to print an entire line of dots. Modifying the flex circuits by elongating them so that the circuit connectors are entirely outside the stationary print head may be desirable when implementing many rows of print heads or more than one stationary print head.

Alternatively, stationary print heads can be implemented from modifications of various single and/or multiple color COTS ink-jet nozzle arrays and/or print heads manufactured by, for example, HP, Canon, Epson, Lexmark, and Xerox.

Figure 6:
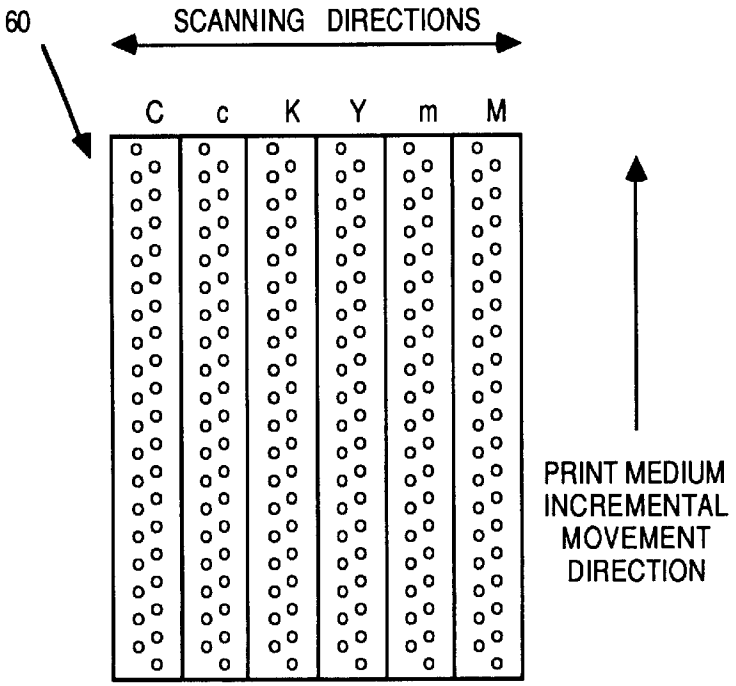
FIG. 6 (PRIOR ART)
FIG. 6 is an enlarged plan view of a prior art print head nozzle array arrangement suitable for use with this invention with its nozzle arrays oriented for printing with conventional bilateral scanning.

FIG. 6 shows a conventional nozzle array arrangement 60, such as the arrangement employed in the above-described Canon and HP multicolor print heads, which bidirectionally scan horizontally while the print medium incrementally moves vertically. The nozzle array arrangement is particularly useful in stationary print heads because the CMYKcm nozzle arrays are arranged next to each other in parallel rows rather than end to end as with Lexmark and some Canon print heads. The latter nozzle array arrangements require many more rows of print heads to implement a stationary print head array.

Ink-jet nozzle arrays could be manufactured such that they are a single integrated stationary print head.

A stationary array of individual prints heads can be considered a single print head or an array of print heads.

Figure 7:
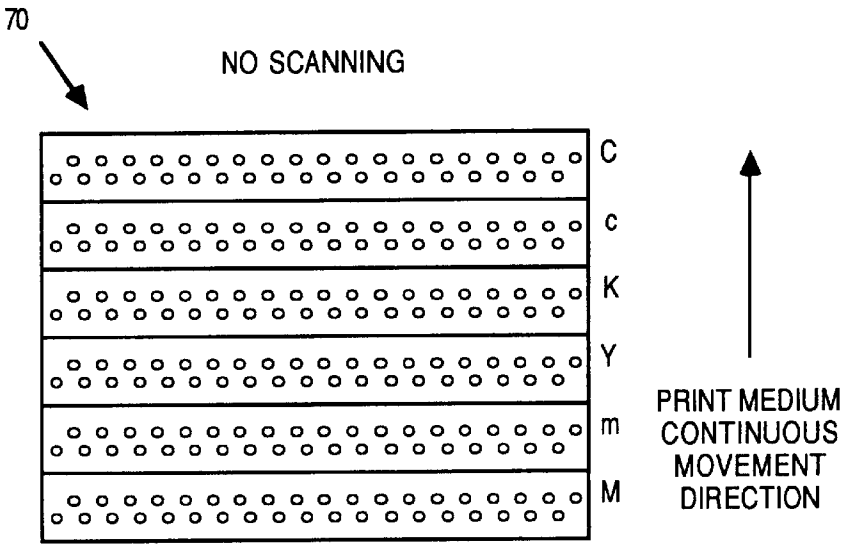
FIG. 7 is an enlarged plan view of the nozzle array of FIG. 6 but with its nozzle arrays oriented for use in the stationary print heads of this invention.

FIG. 7 shows a preferred nozzle array arrangement 70 in which the print heads are reoriented 90 degrees relative to the conventional orientation shown in FIG. 6. Nozzle array arrangement 70 aligns each of the nozzle arrays perpendicular to the direction of print media movement relative to the nozzle arrays, which are stationary. Because HP and Canon print heads eject ink droplets downward in the direction of gravity, reorienting the nozzle arrays has no negative effects on ink flow through the print heads.

Alternatively, the stationary print head array can be made longer by adding additional print heads and reorienting the print medium for long-edge-first feed through the printer to achieve even greater printing speed.

Referring again to FIG. 3, position a first multicolor Canon print head 32A in a first row 72 of stationary print head array 30 such that a left edge 74 of the ink-jet nozzle array is flush with a left edge 76 of the printable image area of a print medium 78.

Position the remaining multicolor Canon print heads 32 in row 72 such that the ink-jet nozzle arrays are spaced apart, center-to-center, by 0.5 inch across the width of the printable image area. Nine (only six are shown) multicolor Canon print heads 32 are required in first row 72 of stationary print head array 30 to print an 8.5 by 11 inch borderless printed page. Eight Canon print heads are required in first row 72 of stationary print head array 30 for printing an 8.5 by 11 inch printed page with 0.25 inch left- and right-side margins.

For other print head models with different spacing requirements, more ink coverage and slightly faster printing speed can be achieved at the expense of more print heads by having no space between the print heads in each row of the stationary print head array. The number of print heads used must account for the dimensions of individual ink-jet nozzle arrays and/or print heads, the width of the printable image area, and the width of the margins necessary to pull the print media through the printer.

Offset a first multicolor Canon print head 32B in a second row 80 of stationary print head array 30 by 0.5 inch to the right of left edge 76 of the printable image area such that an upper-left corner of print head 32B touches the lower-right corner of print head 32A.

Position the remaining multicolor Canon print heads 32 in second row 80 such that the inkjet nozzle arrays of print heads 32 are touching and spaced apart 0.5 inch center-to-center across the width of the printable image area in a manner similar to print heads 32A and 32B.

Eight (six are shown) multicolor Canon print heads 32 are required in second row 80 for printing an 8.5 by 11 inch printed page with or without 0.25 inch margins on the left and right sides of the printed page.

As the print medium continuously moves in one direction through the printer, first and second rows 72 and 80 of print heads print a wide swath comprising an entire linear row of dots across the width of the print medium without any gaps in the printed image. Continuously moving the print media, without incremental movements or bidirectional print head scanning provides significantly improved dot placement accuracy.

Multiple rows of print heads are necessary to print an entire linear row of dots because it is impractical to precisely align adjacent print heads or ink-jet nozzle arrays horizontally in a straight line without any gaps in the image.

Some conventional ink-jet print heads have nozzles that are spaced and arranged such that several bidirectional passes are required to fill a vertical row of dots. Additional rows of print heads can be used to compensate for this variance between nozzle spacing and resolution, but this requires significantly greater precision than is required with the manufacturing method of this invention. In this invention, only four print heads having a 600 dpi nozzle spacing need to be aligned with one another to achieve a 2400 dpi nozzle spacing and a true 2400 by 2400 dpi resolution. Only two print heads having a 1200 dpi nozzle spacing need to be aligned with one another to achieve a 2400 dpi nozzle spacing and a true 2400 by 2400 dpi resolution. Alternatively, increasing the printing resolution of a print head array can be achieved by angularly orientating the print head relative to the direction of print media movement. Of course, an array of such angularly oriented print heads is within the scope of this invention.

When employing single color print heads to fabricate a stationary print head array of this invention, at least two rows of single color print heads are required per color.

It is not necessary to have the entire print media be flat during printing because the stationary print heads are narrow and can be contoured if necessary. This may be particularly important for duplex printing applications to prevent the ink from smearing due to gravity as the print media moves through the printer.

The ink-jet nozzle arrays and/or print heads can be staggered slightly, if necessary, to compensate for firing order to allow accurate dot placement—although, this is not generally an issue due to the extremely fast processors currently available.

FIGS. 1 and 2 represent an 8.75 by 2 inch array of multicolor CMYKcm Canon S800 Color Bubble Jet Photo Printer print heads each having a 0.5 by 256/1200 (0.213) inch nozzle face. When employing 0.25 inch margins, the stationary print head requires: 2 rows of multicolor print heads; 19 multicolor print heads in a first row; 19 multicolor print heads in a second row; and 38 multicolor print heads total. Each six-color Canon S800 Color Bubble Jet Photo Printer print head has 256 nozzles per color, a total of 1,536 nozzles, a 1200 by 2400 dpi resolution, and ejects 4 picoliter ink droplets. The stationary print head includes 38 print heads, 9,728 nozzles per color, and a total of 58,368 nozzles. The print heads in each row of the stationary print head are approximately touching horizontally, with adjacent rows also approximately touching horizontally and offset horizontally by about 0.25 inch. The stationary print head is offset about 0.125 inch outside the edges of the printable image area.

FIGS. 3 and 4 represent an 8.75 by 2 inch array of multicolor CMYKcm Canon S900 Color Bubble Jet Photo Printer print heads each having a 0.5 by 512/1200 inch nozzle face. When employing 0.25 inch margins, the stationary print head requires: 2 rows of multicolor print heads total; 10 multicolor print heads in first row; 9 multicolor print heads in second row; 19 multicolor print heads total; and 19 multicolor print heads total. Each six-color Canon S900 Color Bubble Jet Photo Printer print head has 512 nozzles per color, a total of 3,072 nozzles, a 1200 by 2400 dpi resolution, and ejects 4 picoliter ink droplets. The stationary print head includes 19 print heads, 9,728 nozzles per color, and a total of 58,368 nozzles. The print heads in each row of the stationary print head are approximately touching horizontally, with adjacent rows also approximately touching horizontally and offset horizontally by about 0.5 inch. The stationary print head is offset about 0.25 inch outside the edges of the printable image area.

Stationary print heads of this invention employing Canon S800 and S900 print heads have the specifications set forth below in Table 2.

TABLE 2

| Stationary Print Head Specifications | Canon S800 | Canon S900 |
|---|---|---|
| Stationary Print Head Dimensions | Approximately 8.5 × 2 × 1 inches | Approximately 8.5 × 2 × 1 inches |
| Canon Print Head Dimensions | Approximately 1 square inch | Approximately 1 square inch |
| Nozzle Array Dimensions | Approximately 1/2 by 256/1200 inch | Approximately 1/2 by 512/1200 inch |
| Number of Colors Per Print Head | 6 | 6 |
| Nozzles Per Color Per Print Head | 256 | 512 |
| Number of Nozzles Per Print Head | 1536 | 3072 |
| Total Number of Nozzles Per Color | 9728 | 9728 |
| Total Number of Nozzles | 58368 | 58368 |
| Individual Nozzle Frequency Per Second | 9880+ | 9880+ |
| Number of Print Heads | 38 | 19 |
| Rows of Print Heads | 2 | 2 |
| Speed (ppm) | 22+ | 22+ |
| Duplex Speed (ppm) | 44+ | 44+ |
| Resolution (dpi) | 1200 by 2400 | 1200 by 2400 |
| Dot Size | 4 picoliters | 4 picoliters |
| Gradation Levels | 49 | 49 |
| Color Lightfastness | 25 years | 25 years |
| Ink Drying Time | <1 second | <1 second |

The stationary print head configuration with Canon S900 Photo Printer print heads is capable of printing a least 22 single-sided 8.5 by 11 inch ppm and at least 44 two-sided 8.5 by 11 inch ppm (duplex).

With a single 0.5 square inch ink-jet nozzle array (6 colors) the Canon S900 Photo Printer is capable of printing an 8.5 by 11 inch high-resolution borderless page in one minute. To print all six colors across the width of a page, a single non-stationary print head must pass at least 0.5 inch beyond the left and right sides of the printable image area (borderless page) as it bilaterally scans. Because the print head has a 1200 dots per linear inch resolution, and the print head deposits 512 rows per unilateral pass, at least 26 extra inches must be traversed by the Canon S900 print head per 8.5 by 11 inch page. These performance parameters are calculated as follows:

$$1 \text{ print head} \times 1 \text{ minute} = 1 \text{ ppm}$$

$$\frac{11 \text{ inches} \times 1200 \text{ dpi}}{512 \text{ dot per pass}} = 25.78 \text{ passes}$$

$$26 \text{ passes} \times 9.5 \text{ inches} = 247 \text{ inches per minute}$$

$$\frac{247 \text{ inches per minute}}{11 \text{ inches}} = 22.45 \text{ ppm}$$

$$\frac{0.22 \text{ pass} \times 512 \text{ doter per pass}}{1200 \text{ dpi}} = 0.09 \text{ inches}$$

$$\frac{247 \text{ inches per minute}}{11.90 \text{ inches}} = 22.27 \text{ ppm}$$

-continued $$\frac{247 \text{ inches} \times 2400 \text{ dpi}}{60 \text{ seconds}} = 9880 \text{ dots per nozzle per second}$$

$$\frac{3 \text{ inches} \times 60 \text{ seconds}}{247 \text{ inches}} = 0.72 \text{ extra seconds}$$

$$\frac{58368 \text{ orifices} \times 9880 \text{ frequency}}{2400 \text{ dpi} \times 1 \text{ pass}} = 240281.6 \text{ marking throughput}$$

Pass number 26 on the first page can print an extra 0.09 inches on the second page.

Add 0.72 seconds for the time required to print 1.5 extra inches at the top of the first sheet and 1.5 inches at the bottom edge of the last sheet.

Printing speed increases because the print media moves continuously, rather than incrementally, when employing a stationary print head.

Printing speed, as described above, includes full coverage by ink of each color, which deposits more ink than is typically required.

The stationary print head dimensions can be substantially reduced if the flex circuits are contorted or modified.

Yet another stationary print head of this invention includes an 8.75 by 6 inch array of single color HP print heads, such as the HP 15, 40, and 45 print heads (0.75 inches square) for printing a CMYK color image on an 8.5 inch wide print medium. The stationary print head comprises: 2 rows of print heads per color; 8 rows of print heads total; 17 print heads per color; and 68 print heads total. The print heads in each row of this configuration are horizontally spaced apart about 0.25 inch with adjacent rows offset horizontally about 0.50 inch and approximately touching one another. This stationary print head is offset 0.125 inch outside the side edges of the printable image area. The dimensions of this stationary print head can be substantially reduced if the plastic flex circuits are contorted or modified.

Still another stationary print head of this invention includes an 8.75 by 6 inch array of single color HP print heads, such as the HP 19, 20, 26, 29, and 33 print heads (0.75 by 0.25 inches) for printing a CMYK color image on an 8.5 inch wide print medium. The stationary print head comprises: 2 rows of print heads per color; 8 rows of print heads total; 34 print heads per color; and 136 print heads total. The print heads in each row of this configuration are horizontally spaced apart about 0.25 inch with adjacent rows offset horizontally about 0.25 inch and approximately touching one another. This stationary print head is about flush with the outside edges of the printable image area. The dimensions of this stationary print head can be substantially reduced if the flex circuits are contorted or modified.

Yet another stationary print head of this invention includes an 8.75 by 3 inch array of multicolor (CMY) HP print heads, such as HP 16, 17, 23, 25, 41, 49, 78, 844, and 845 (0.75 by 0.25 inch) and single color (K) HP print heads, such as HP 15, 40, and 45 (0.75 inch square) for printing a CMYK color image on an 8.5 inch wide print medium. The stationary print head comprises: 2 rows of multicolor print heads (CMY); 2 rows of single color print heads (black); 4 rows of print heads total; 34 multicolor print heads (CMY); 17 single color print heads (K); and 51 print heads total. The print heads in each row are horizontally spaced apart 0.25 inch, adjacent multicolor rows are horizontally offset about 0.25 inch, adjacent single color rows are offset horizontally about 0.50 inch, adjacent rows are approximately touching, and the stationary print head is offset about 0.125 inch outside the side edges of the printable image area. The print head dimensions can be made substantially reduced if the flex circuits are contorted or modified.

Still another stationary print head of this invention includes an 8.75 by 3 inch array of multicolor (CMY) HP print heads, such as HP 16, 17, 23, 25, 41, 49, 78, 844, and 845 (0.75 by 0.25 inch) for printing a color image on an 8.5 inch wide print medium. The stationary print head comprises: 4 rows of multicolor print heads total; and 68 multicolor print heads total. The print heads in each row of this configuration and horizontally spaced apart about 0.25 inch, adjacent rows are offset horizontally about 0.25 inch, are approximately touching one another, and the stationary print head is about flush with the side edges of print medium. The dimensions of this stationary print head can be substantially reduced if the plastic flex circuits are contorted or modified.

Some older conventional ink-jet print heads have droplet ejection frequencies as high as 10,000 droplets per nozzle per second, whereas some newer conventional ink-jet print heads have droplet ejection frequencies of over 36,000 droplets per nozzle per second. For example, the HP DesignJet 1000c has droplet ejection frequencies approaching 30,000 droplets per nozzle per second. Therefore, stationary print heads employing such print heads can achieve single-sided media printing speeds with COTS print head technology (duplex printing doubles the speed) as shown below in Table 3:

TABLE 3

| Nozzle Frequency (Droplets Per second) | Resolution (dpi) | Inches Per Second (ips) | Feet Per Minute (fpm) | 8.5" by 11" Pages Per Minute (ppm) Portrait | 8.5" by 11" Pages Per Minute (ppm) Landscape |
|---|---|---|---|---|---|
| 9600 | 2400 by 2400 | 4 | 20 | 21.81 | 28.23 |
| 9600 | 1200 by 2400 | 4 | 20 | 21.81 | 28.23 |
| 9600 | 1200 × 1200 | 8 | 40 | 43.63 | 56.47 |
| 12000 | 2400 by 2400 | 5 | 25 | 27.27 | 35.29 |
| 12000 | 1200 by 2400 | 5 | 25 | 27.27 | 35.29 |
| 12000 | 1200 by 1200 | 10 | 50 | 54.54 | 70.58 |
| 36000 | 2400 by 2400 | 15 | 75 | 81.81 | 105.88 |
| 36000 | 1200 by 2400 | 15 | 75 | 81.81 | 105.88 |
| 36000 | 1200 by 1200 | 30 | 150 | 163.63 | 211.76 |

The printing speeds set forth in Table 3 are based on printing every pixel location in a high-resolution image bitmap with a droplet of each color (CMYK) ink from the stationary print head array. In practice, however, the ink-jet nozzles do not operate close to their maximum frequency because a droplet of only one color per pixel is typically printed in the high-resolution image bitmap. Accordingly, a statistical analysis of color utilization could provide a color distribution algorithm for yielding even higher printing speeds.

Higher printing speed may also be achieved by employing variable-sized ink droplets, particularly if the different sized droplets are ejected at the same nozzle frequencies. For example, 1200 dpi droplets and 2400 dpi droplets printed with the same nozzle frequencies effectively double the printing speeds set forth in Table 3. Different sized droplets are commonly employed for printing continuous tones and spot colors.

Many print heads can achieve a higher dpi resolution in one dimension than in the second orthogonal dimension. For example, Epson print heads have 720 by 2880 dpi resolution, and Canon S800 and S900 print heads have 1200 by 2400 dpi resolution. Accordingly, this invention orients the print heads to take advantage of the higher dpi resolution.

Conventional printers with non-stationary print heads waste significant time by bilaterally scanning and incrementing the print media through the printer, which reduces printing speeds. Additionally, extra time is wasted because non-stationary color print heads must scan at least the width of the non-stationary color ink-jet nozzle array on both sides of the printable image area to print all ink colors.

In contrast, the stationary print heads of this invention require only a single unilateral, non-incremental scan of the print head array relative to the print medium to print the entire medium. Therefore, stationary print heads can print an entire page in about the same time as a single swath scan of a conventional print head.

Figure 8:
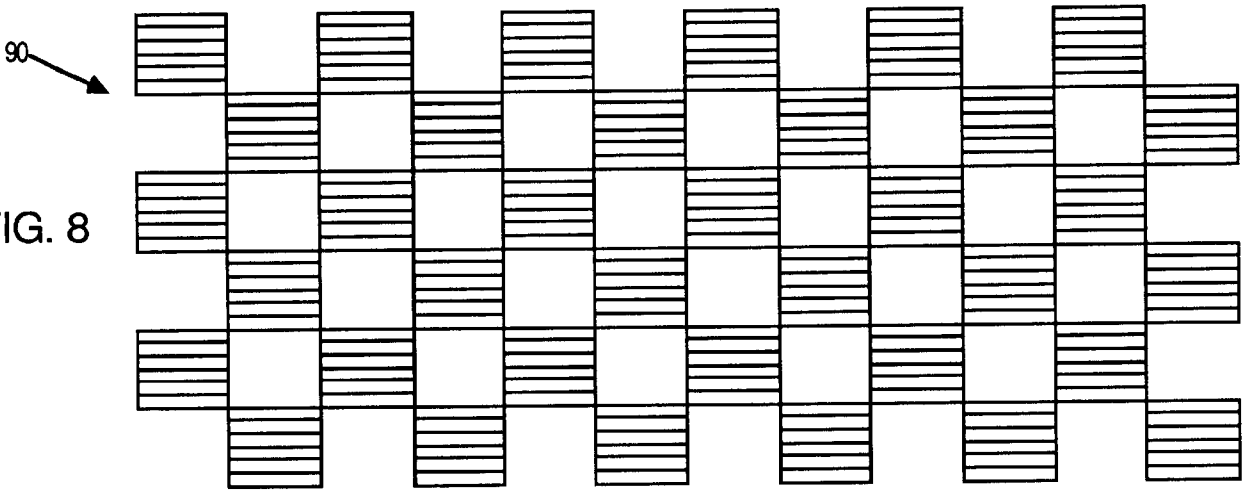
FIG. 8 is a simplified plan view of a six row, staggered print head arrangement of this invention.
Figure 9:
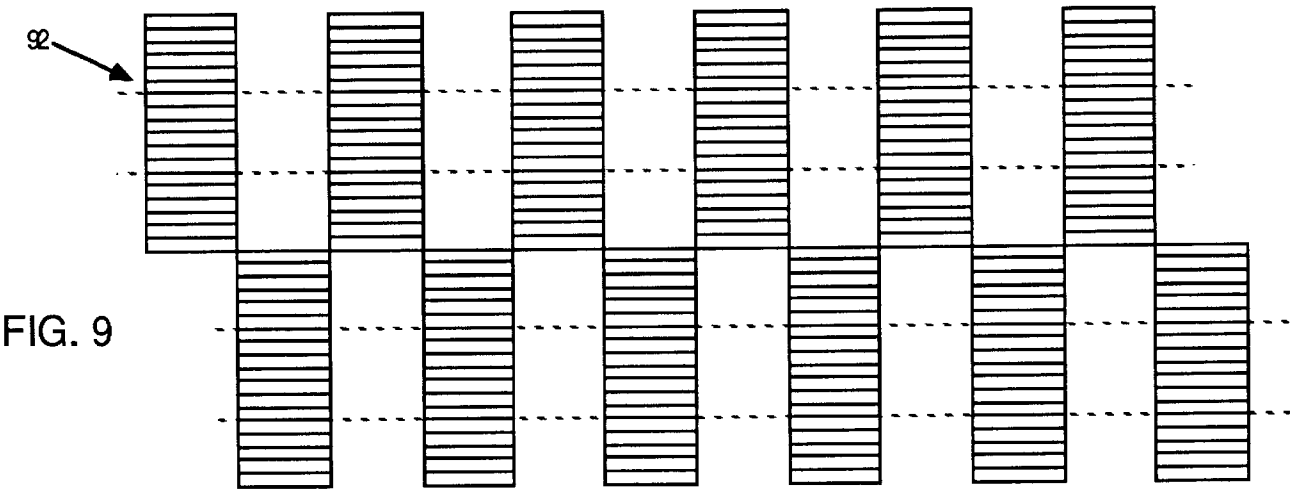
FIG. 9 is a simplified plan view of a six row aligned and staggered print head arrangement of this invention.

Even higher printing speeds can be achieved by adding more rows of print heads to the stationary print head array or by using more stationary print heads. This is a useful configuration for high-speed production printing and digital printing press applications. The print head rows can be staggered or grouped together with many possible variations. For example, high-resolution digital printers may employ four or more print heads arranged in linear rows. FIG. 8 shows a six row, staggered print head array arrangement 90, and FIG. 9 shows a six row aligned and staggered print head arrangement 92.

The stationary print heads of this invention eliminate the components required for: bilaterally scanning print heads across the print medium; incrementally moving the print medium through the printer; and duplexing the print medium for two-sided printing. Elimination of these components provides lower printer costs and improved reliability.

Figure 10:
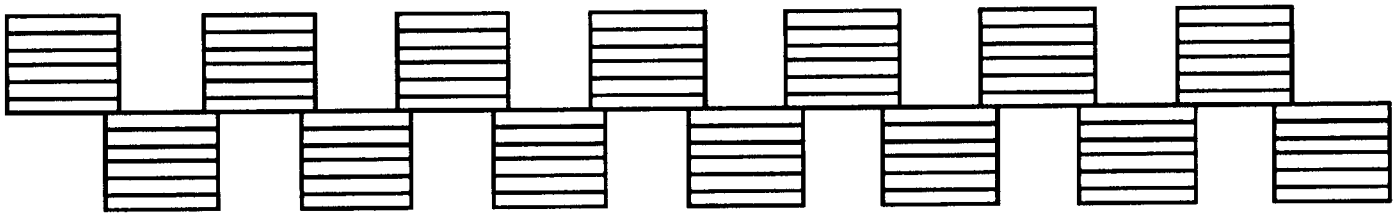
FIG. 10 is a simplified plan view of the FIG. 3 print head arrangement modified with a reduced nozzle array horizontal spacing to accommodate a manufacturing method of this invention.
Figure 11:
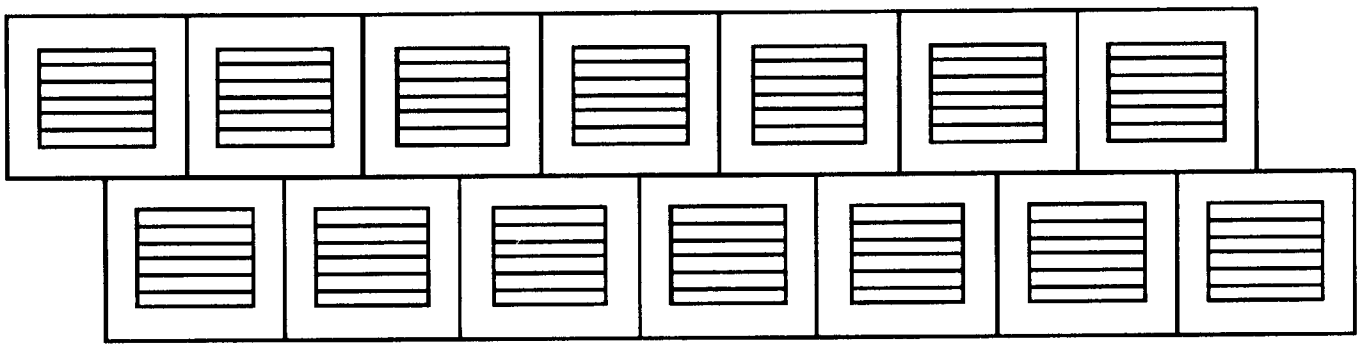
FIG. 11 is a simplified plan view of the FIG. 4 print head arrangement modified with a reduced nozzle array horizontal spacing to accommodate a manufacturing method of this invention.

Slight modifications may be required to some configurations of stationary print heads, such as the configurations of FIGS. 3 and 4, for compatibility with the manufacturing method of this invention. For example, FIGS. 10 and 11 show the FIG. 3 and 4 print heads with reduced nozzle array horizontal spacing (<0.5 inch), to accommodate the imprecise positioning and alignment of print heads in the stationary print head array. The closer spacing is not an issue because printers need relatively large margins on the left and right edges of the print media to move the print media through the printer. Another print head can be added if necessary. The flex circuits connected to the Canon S900 Photo Printer print heads may need to be contorted or modified to achieve this reduced spacing.

Stationary print heads provide significantly improved dot placement precision than non-stationary print heads because bilateral scanning errors and incremental print media movement are eliminated. Bidirectional print head scanning is subject to ink dot landing position errors caused by transit time from the ink-jet nozzles to the print media. Changing the print media thickness makes this problem worse. Continuously moving the print medium through the printer prevents such ink drop landing position errors and allows for straight-forward software correction of any imprecise print head alignment.

The manufacturing method of this invention can align the stationary print heads on both sides of the print medium for duplex printing. Using an array of 2400 dpi print heads allows the manufacturing method of this invention to provide a side-to-side nozzle registration of about 0.00083 inch.

The manufacturing method of this invention enables making a molded plastic case and ink container for packaging together the stationary print heads of this invention. A common ink container can be compartmentalized for each of the different color inks. Individual ink containers are feasible but more complicated and expensive. The ink-jet nozzle arrays and/or print heads can be continuously replenished with ink from the ink container without being removed or replaced. Optionally, the different colored inks can be fed to the ink container through tubes connected to separate ink containers inside or outside the printer. A good example of this ink feed system is the HP Modular Ink Delivery System, which provides improved reliability because air is not allowed inside the stationary print head itself, which reduces nozzle clogging. Nevertheless, print head cleaning may still be periodically required. The stationary print head can be made permanent or replaceable.

The common ink container can be pressurized or depressurized either with a pump or gravity acting on a large quantity of ink in a separate raised or lowered container inside or outside of the printer. Ink supply systems similar to those employed by HP, Canon, Epson, or other printer manufacturers could be used as well.

Alternatively, each individual ink-jet nozzle array and/or print head can be fed ink directly by its own ink tube or tubes rather than using a common ink container. In this embodiment, only the ink needs to be replenished rather than having the print heads and the ink replaced. A good example of this ink feed system is the Canon Think Tank System, which is employed in the Canon S800, S900, and i950 Color Bubble Jet Printers.

Newly designed and manufactured multicolor print heads that include more nozzles, higher nozzle density, and/or more ink colors (six colors are generally sufficient) would also be smaller and more efficient but probably more expensive. The six-color Canon S900 and i950 Photo Printer print heads are ideal in almost every respect. In general, print heads in which the nozzle array for each color are arranged one on top of another requires fewer print heads per stationary print head array than nozzle arrays in which each color is arranged end to end. Six-color Canon and three-color HP print heads arrange the colors one on top of another, whereas three-color Lexmark and some four-color Canon print heads arrange the colors end to end.

Print media delivery systems suitable for use with the stationary print heads of this invention are available in various high-speed COTS printers. Sensing the speed at which the print medium is moving entails coupling a rotary encoder to one of the media feed rollers that move the print medium past the stationary print head(s). Retrofitting the stationary print heads of this invention into a suitable COTS printer could provide a high-performance, low-cost printer for the consumer market. The only newly manufactured parts required in the printer include the plastic casing for the stationary print head array, the ink delivery system, the control circuitry for the stationary print head, and a circuit board that includes a print head array device driver of this invention. The circuit connectors that connect the circuit board and the flex circuits can be multiplexed for simplicity and to save space, parts and costs.

Home printers typically achieve printing speeds of about 20 ppm for low-resolution black text and about 0.5 to 1 ppm for high-resolution color images. Employing stationary print heads would allow printing high-resolution color images at the maximum print medium feed rate of the target COTS home printer.

Employing stationary print heads to print both sides of the print media (duplexing) in a single pass through the printer, provides a low-cost, reliable single pass duplex printing capability and effectively doubles the printing speed. Duplexing mechanisms generally cause most print media jams and service calls for a printer. Eliminating the duplexer mechanism from a double-sided printer significantly reduces the printer cost and improves reliability. Also, the duplex printing of this invention provides significantly improved registration of the images on both sides of the print media. Nevertheless, such duplexing may cause gravity-related problems because ink deposited on the bottom side of the print media may smear as it moves through the printer or settles in the print media collection bin, and some print heads may not be able to eject ink droplets in an upward direction.

One solution to the gravity problem is to route the unprinted side of the print medium around a drum so that the unprinted side exits the drum facing up. A second stationary print head array can then print the second side of the print medium.

The manufacturing method of this invention, which is described later, times and registers the printing from stationary print heads on both sides of the print media to an alignment suitable for duplex printing. For example, employing 2400 dpi print heads allows a side-to-side print media registration within at least about $1/1200$ (0.00083) inch.

High-speed printers, and particularly high-speed duplexing printers, require solutions for above-described the ink smearing problem. Fortunately there are several alternative solutions available.

A solution may be providing adequate ink drying time by placing the stationary print heads close to the print media feed roller exit.

Fast-drying ink is available from several manufacturers. Such inks are capable of substantially drying in less than one second, which makes 120 ppm duplex printing feasible without employing any additional ink drying techniques. For example, HP Versatile Black Ink is a pigment-based ink that dries in less than one second on uncoated print media and in less than one second on heated, coated print media, which is sufficient to prevent image transfer or smearing.

Another solution is to provide additional ink drying time by providing a substantial drop distance into the print media collection bin.

Yet another solution that is especially useful in production printers and digital printing presses is to provide a longer print media exit path from the printer.

A further solution is to provide a print media carriage system that prevents the front edge of the print medium exiting the printer from scraping across the immediately prior printed print medium.

Of course, an optional forced hot-air heater can accelerate the ink drying process.

The cost-effectiveness of printers employing the stationary print heads of this invention make them particularly applicable in various printing applications, such as home and office printers, copiers, duplexers, production printers, digital printing presses with sheet or web feed, large format printers, photo printers, multipurpose printers, all-in-one printers, kiosk printers, point-of-sale printers, digital plate setters, digital prepress proofing printers, and facsimile machines.

There are many printing applications for such printers including newspapers; books and magazines; photographic quality color books and magazines that can be printed in collated order without printing plates; variable information applications, such as checks, negotiable instruments, business forms, accounting statements, direct mail, tickets, receipts, serial numbers, bar codes, and mailing information that can be printed directly on magazines.

Employing the stationary print heads of this invention to printing newspapers, books, magazines, and other commercial printing applications, eliminates the material, equipment, employees and time associated with processing photographic color separations, photographic films, and printing plates. The costs associated with photographic separations and printing plates account for half or more of the cost of virtually all commercial printing jobs. Also eliminated are much of the cost of re-making photographic color separations, films, and plates for edited pages; photographic darkrooms; cleaning associated with inks and printing plates; hazardous materials; hazardous material liability insurance; hazardous waste disposal; state or federally mandated hazardous waste disposal procedures; special chemical ventilation; and collating. Printing variable information is an integrated process, and no print medium is wasted starting and stopping the press. Finally, there is minimal printing press down time other than for scheduled maintenance.

Skilled workers know that it is difficult and costly to precisely align a large array of high-resolution digital print heads, whereas imprecise alignment is easy.

The manufacturing method of this invention starts with an imprecisely aligned array of print heads, precisely measures their nozzle jetting positions within the array, and compensates for their imprecise alignment with a software or firmware device driver. The manufacturing method of this invention is carried out as follows:

Assemble the print heads in a print head array carrier. The print head array carriers may be low-cost molded plastic rather than expensive laser cut or machined pieces. COTS print heads are preferably employed and are continuously replenished with ink without requiring removal or replacement. Alternatively, the print heads can be separately mounted without a carrier to form a stationary print head.

Print one or more high-resolution dots from one or more of the same nozzles of every print head in the array. Printing dots from at least two nozzles in every print head allows this manufacturing method to determine an angular orientation of each nozzle array relative other nozzle arrays in the entire print head. The print heads can be staggered slightly, if necessary, to compensate for firing order to allow accurate dot placement, although, this is not generally an issue because of the fast processors currently available.

Scan the printed output with a high-resolution scanner. Output from a print head array that is larger than the scanner capacity can be scanned in overlapping sections without any loss of precision.

Any accumulation of error due to scanning can be compensated by the device driver software by: measuring the position of each print head relative to an adjacent print head in the previous row or column in the array; adding or subtracting any error in the actual alignment of the adjacent print head with respect to where it should be if it were exactly aligned with the imaginary dot placement matrix; and adding the absolute coordinates of where the adjacent print head should be if it were exactly aligned with the imaginary dot placement matrix. This is necessary because the absolute error accumulated over a large area due to scanning can be relatively large even though the absolute error accumulated between adjacent rows and columns is small.

It is also possible to scan the print head array itself rather than the printed output. However, sophisticated pattern recognition software may be required to find the placement of the ink-jet nozzles.

Determine the precise placement of the print heads in the array by digitally measuring via software the precise placement of dots printed by each print head in the array as scanned by the high-resolution scanner.

Even though the absolute error in the placement of the print heads within the array could be quite large, the dot placement error on the printed page by a stationary print head array is very small.

By imposing an imaginary dot placement matrix, a sort of bit map, between the print head array and the printed page, it can be determined that each print head in the array prints dots that are never misplaced more than one half the width or height of a single square within the imaginary dot placement matrix. For example, if the print heads and the imaginary dot placement matrix have a true resolution of 2,400 dpi then the dot placement error for a stationary print head array is never more than $1/4{,}800$ (0.0002) inch even though the absolute error in the placement of the print heads in the array could be quite large. Any gaps or overlaps in the imaginary dot placement matrix created by the imprecise alignment of the print heads in the array can easily be compensated by the device driver software.

No matter how large the print head array, the precision afforded by this manufacturing method is better than the manufacturing tolerances used to precisely align much smaller arrays employed for printing photographic quality images.

Compensate for the imprecise alignment of the print heads in the array with the device driver software.

Any gaps or overlaps in the imaginary dot placement matrix created by the imprecise alignment of the print heads in the array is compensated for by having some print heads partially overlap the coverage areas of adjacent print heads. The device driver then steers and times printing to the appropriate nozzle(s) in the appropriate print head(s) to eliminate the gaps or overlaps.

The manufacturing method of this invention can be employed to align the ink-jet nozzle arrays and/or print heads used in duplex printers that print both sides of the print media simultaneously or at different times, but in a single pass through the printer, as follows:

Print one or more high-resolution dots, using one color, from one or more of the same nozzles of every print head in the first array, on the first side of a transparent print medium.

Print one or more high-resolution dots, using a different ink color, from one or more of the same nozzles of every print head in the second array, on the second side of the transparent print medium.

Scan the color output with a high-resolution color scanner as described above.

Determine the precise placement of the first print head array relative to the second print head array by digitally measuring the precise placement of different color dots printed by each print head array as scanned by the high-resolution color scanner.

The offset of the nozzles that print different colors, or offsets between print head arrays for duplex printing, is accounted for by timing delays generated by the device driver software.

No fixed reference point whatever are required.

Employing two 2400 dpi print heads allows a side-to-side printing registration of at least about $1/1200$ (0.00083) inch.

The precise placement of the print head arrays can also be determined by measuring the precise placement of each individual print head within the print head arrays relative to one another or by measuring the precise placement of the first and/or last ink-jet nozzle arrays and/or print heads in each stationary print head relative to its respective stationary print head and then precisely placing or measuring the precise placement of the stationary print heads relative to one another.

The print head array portable device driver of this invention is a software or firmware program that controls all of the print heads within the print head array. The print head array device driver:

is hardware and operating system independent (it is portable);

accommodates digital print head arrays of any dimensions with any types of print heads;

accommodates stationary and non-stationary print head arrays; and is simpler and faster for stationary rather than non-stationary print head arrays because bilateral scanning is eliminated.

A preferred embodiment of the print head array portable device driver of this invention generally follows the program steps set forth below.

(1) Input print head array configuration data.

(2) For each successive printable image segment:
  (a) For each print head in the array:
    (1) For each color in the print head:
      (a) Map dots in corresponding color separation to color printing elements.

(3) Call dot placement timing function.

(4) Output multiplexing signals.

(5) Output signals to nozzles. Go to step (2).

The stationary print heads of this invention do not require interlacing or microweaving of dots rows to prevent print banding and other artifacts. The device driver eliminates or reduces the need for licensing proprietary embedded digital imaging software, such as Adobe Postscript. This is particularly important reducing the cost of home printers, and simplifies the design and reduces the cost of the printer circuit boards.

Digital imaging applications, such as preparing CMYK color separations, can be handled by, for example, Adobe Photoshop.

It will be obvious to those having skill in the art that many changes may be made to the details of the above-described embodiments without departing from the underlying principles of the invention. The scope of the present invention should, therefore, be determined only by the following claims.

I claim:

1. A printing system for printing a first image including first image portions and having a defined image width on a first side of a print medium, comprising:

at least a first print head array including multiple rows of multiple print heads that each include at least one printing array, wherein each row includes a plurality of print heads distributed in a first direction for printing in corresponding areas of the first side of the print medium, the multiple rows of print heads oriented with their printing arrays aligned at an acute angle relative to the first direction and arranged for printing throughout the defined image width of the first image;

a device driver coupling the first image portions to corresponding ones of the printing arrays; and a mechanism for moving the print medium in a second direction perpendicular to the first direction such that the device driver and first image portions coact to print the first image on the first side of the print medium.

2. The system of claim 1, in which the acute angle is about zero degrees.

3. The system of claim 1, in which the print head array comprises ink-jet print heads.

4. The system of claim 3, in which the ink-jet print heads include color ink printing arrays.

5. The system of claim 1, in which the first print head array is contained by a print head carrier.

6. The system of claim 5, in which the print head carrier further includes an ink delivery system for providing ink to the multiple print heads.

7. The system of claim 1, in which the mechanism moves the print medium in a continuous movement.

8. The system of claim 1, further including a movement sensor coupled to the mechanism for coordinating delivery by the device driver of the first image portions to the corresponding printing arrays.

9. The system of claim 1, further including a second print head array positioned for printing a second image on a second side of the print medium.

10. The system of claim 9, in which the first and second images print at substantially the same time.

11. A method for printing a first image including first image portions and having a defined image width on a first side of a print medium, comprising:

providing at least a first print head array including multiple rows of multiple print heads each including at least one printing array;

distributing the print heads in each row in a first direction throughout the defined image width for printing in corresponding areas of the first side of the print medium, orienting the multiple rows of print heads such that their printing arrays are aligned at an acute angle relative to the first direction;

coupling the first image portions to corresponding ones of the printing arrays; and moving the print medium in a second direction perpendicular to the first direction such that the first image portions print the first image on the first side of the print medium.

12. The method of claim 11, in which the acute angle is about zero degrees.

13. The method of claim 11, in which the print head array comprises ink-jet print heads.

14. The method of claim 13, in which the ink-jet print heads include color ink printing arrays.

15. The method of claim 11, further including containing the first print head array in a print head carrier.

16. The method of claim 15, in which the print head carrier further includes an ink delivery system for providing ink to the multiple print heads.

17. The method of claim 11, in which the moving of print medium is a continuous movement.

18. The method of claim 11, further including sensing the movement for coordinating delivery of the first image portions to the corresponding printing arrays.

19. The method of claim 11, further including positioning a second print head array for printing a second image on a second side of the print medium.

20. The method of claim 19, further including printing the first and second images at substantially the same time.

* * * * *

UNITED STATES PATENT AND TRADEMARK OFFICE

CERTIFICATE OF CORRECTION

PATENT NO. : 6,767,073 B2
DATED : July 27, 2004
INVENTOR(S) : Tschida

It is certified that error appears in the above-identified patent and that said Letters Patent is hereby corrected as shown below:

Column 10,
Line 21, “inkjet print heads” should read -- ink-jet print heads --.

Column 11,
Line 52, “the inkjet nozzle” should read -- the ink-jet nozzle --.

Column 13,
Line 66, “11.90 inches” should read -- 11.09 inches --.

Signed and Sealed this

Eighth Day of February, 2005

JON W. DUDAS
*Director of the United States Patent and Trademark Office*